US009016898B2

(12) United States Patent
Lee et al.

(10) Patent No.: US 9,016,898 B2
(45) Date of Patent: Apr. 28, 2015

(54) CIRCUIT BOARD INCLUDING LIGHT-EMITTING ELEMENTS AND DISPLAY APPARATUS INCLUDING THE CIRCUIT BOARD

(75) Inventors: Bum Lee, Cheonan-si (KR); Seoung-Bum Pyoun, Hwaseong-si (KR); Il-Koo Nah, Yongin-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 959 days.

(21) Appl. No.: 13/049,226

(22) Filed: Mar. 16, 2011

(65) Prior Publication Data

US 2011/0227494 A1 Sep. 22, 2011

(30) Foreign Application Priority Data

Mar. 16, 2010 (KR) ..... 10-2010-0023359

(51) Int. Cl.
*F21V 21/00* (2006.01)
*H05B 33/08* (2006.01)

(52) U.S. Cl.
CPC ..... *H05B 33/0803* (2013.01)

(58) Field of Classification Search
CPC .... H05B 33/02; H05B 33/0803; H05B 37/02; F21V 21/00
USPC ..... 315/185 R, 192; 362/249.01, 249.02; 257/88, E33.001, E33.057, E33.066
See application file for complete search history.

(56) References Cited

U.S. PATENT DOCUMENTS

| | | | | |
|---|---|---|---|---|
| 2004/0052087 | A1* | 3/2004 | Miyazaki | 362/545 |
| 2009/0116223 | A1* | 5/2009 | Hamada | 362/97.2 |
| 2010/0220479 | A1* | 9/2010 | Yamashita et al. | 362/249.02 |

FOREIGN PATENT DOCUMENTS

| | | |
|---|---|---|
| JP | 2008-084790 | 4/2008 |
| KR | 100755615 | 8/2007 |
| KR | 1020070117692 | 12/2007 |

* cited by examiner

*Primary Examiner* — Jimmy Vu
(74) *Attorney, Agent, or Firm* — F. Chau & Associates, LLC

(57) ABSTRACT

A circuit board for a display apparatus includes a substrate, a plurality of light-emitting elements arranged substantially in a line on the substrate, and a plurality of branch lines connecting the light-emitting elements to each other in series. A first group of the plurality of branch lines is formed on a first side of the line of the plurality of light-emitting elements, and a second group of the plurality of branch lines is formed on a second, opposing side of the line of the plurality of light-emitting elements.

20 Claims, 4 Drawing Sheets

CIRCUIT BOARD INCLUDING LIGHT-EMITTING ELEMENTS AND DISPLAY APPARATUS INCLUDING THE CIRCUIT BOARD

This application claims priority to and the benefit of Korean Patent Application No. 10-2010-0023359 filed on Mar. 16, 2010 in the Korean Intellectual Property Office, the entire contents of which are incorporated by reference herein.

BACKGROUND OF THE INVENTION

1. Technical Field

The present invention relates to a circuit board including light-emitting elements and a display apparatus including the circuit board.

2. Discussion of the Related Art

Light-emitting diodes (LEDs) consume relatively low power while providing the same luminance as conventional light-emitting elements. LEDs further have long life cycles and high color reproduction. As a result, the use of LEDs as light sources has increased in many fields such as, for example, the field of displays.

Liquid crystal displays (LCDs) utilize a light source to emit light. Specifically, an LCD includes a backlight unit under an LCD panel. Light emitted from the backlight unit allows the LCD to display an image. LEDs may also be used as a light source for the backlight unit.

A backlight unit may include a plurality of LEDs mounted on a circuit board. Every predetermined number of LEDs may form a block, and the predetermined number of LEDs in each block may be connected to each other in series. An end of each block may be connected to a power line that drives the predetermined number of LEDs, and the other end of each block may function as a feedback line that is connected to a light-emitting control unit. In this case, the circuit board may be multi-layered to prevent the wiring connecting one block from intersecting with the wiring connecting another block. However, the unit cost of a multi-layer circuit board is higher than that of a single-layer circuit board.

SUMMARY OF THE INVENTION

An exemplary embodiment of the present invention includes a circuit board which can reduce the unit cost of production.

An exemplary embodiment of the present invention includes a display apparatus including the circuit board.

However, the present invention is not limited to the exemplary embodiments set forth herein. The above and other aspects of the present invention will become more apparent to one of ordinary skill in the art to which the present invention pertains by referencing the detailed description of the embodiments of the present invention given below.

According to an exemplary embodiment of the present invention, a circuit board includes a substrate, a plurality of light-emitting elements arranged substantially in a line on the substrate, and a plurality of branch lines connecting the light-emitting elements to each other in series. A first group of the plurality of branch lines is formed on a first side of the line of the plurality of light-emitting elements, and a second group of the plurality of branch lines is formed on a second, opposing side of the line of the plurality of light-emitting elements.

According to another exemplary embodiment of the present invention, a display apparatus includes a display panel, and a backlight unit supplying light to the display panel. The backlight unit includes a plurality of light-emitting elements mounted on a substrate, and at least one of the light-emitting elements is connected to an internal wiring on the substrate. The plurality of light-emitting elements are arranged substantially in a line on the substrate and are connected in series by a plurality of branch lines. A first group of the plurality of branch lines is formed on a first side of the line of the plurality of light-emitting elements, and a second group of the plurality of branch lines is formed on a second, opposing side of the line of the plurality of light-emitting elements.

BRIEF DESCRIPTION OF THE DRAWINGS

The embodiments of the present invention will become more apparent by describing in detail exemplary embodiments thereof with reference to the attached drawings, in which.

DETAILED DESCRIPTION OF THE EXEMPLARY EMBODIMENTS

Exemplary embodiments of the present invention will be described more fully hereinafter with reference to the accompanying drawings, in which like numbers refer to like elements throughout. The invention may, however, be embodied in many different forms and should not be construed as limited to the exemplary embodiments set forth herein.

It will be understood that when an element such as a layer, a film, a region or a plate is referred to as being "on" another element, the element can be directly on another element or intervening elements may be present.

It will also be understood that when an element or layer is referred to as being "connected to" or "coupled to" another element or layer, it can be directly connected or coupled to the other element or layer or intervening elements or layers may be present. As used herein, the term "and/or" includes any and all combinations of one or more of the associated listed items.

Figure 1:
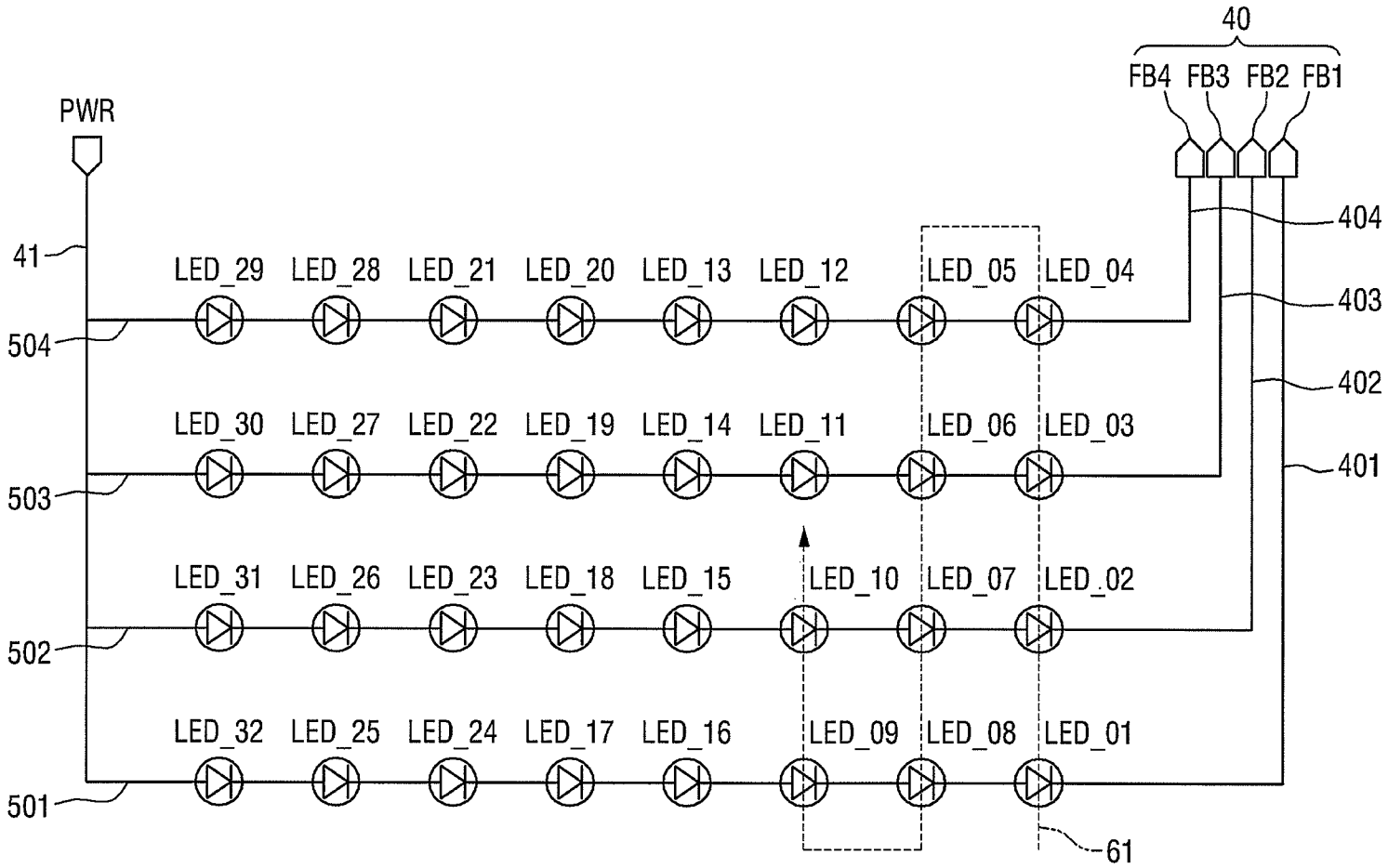
FIG. 1 is a circuit diagram illustrating a plurality of light-emitting elements of a circuit board and the connections between the light-emitting elements, according to an exemplary embodiment of the present invention.
Figure 2:
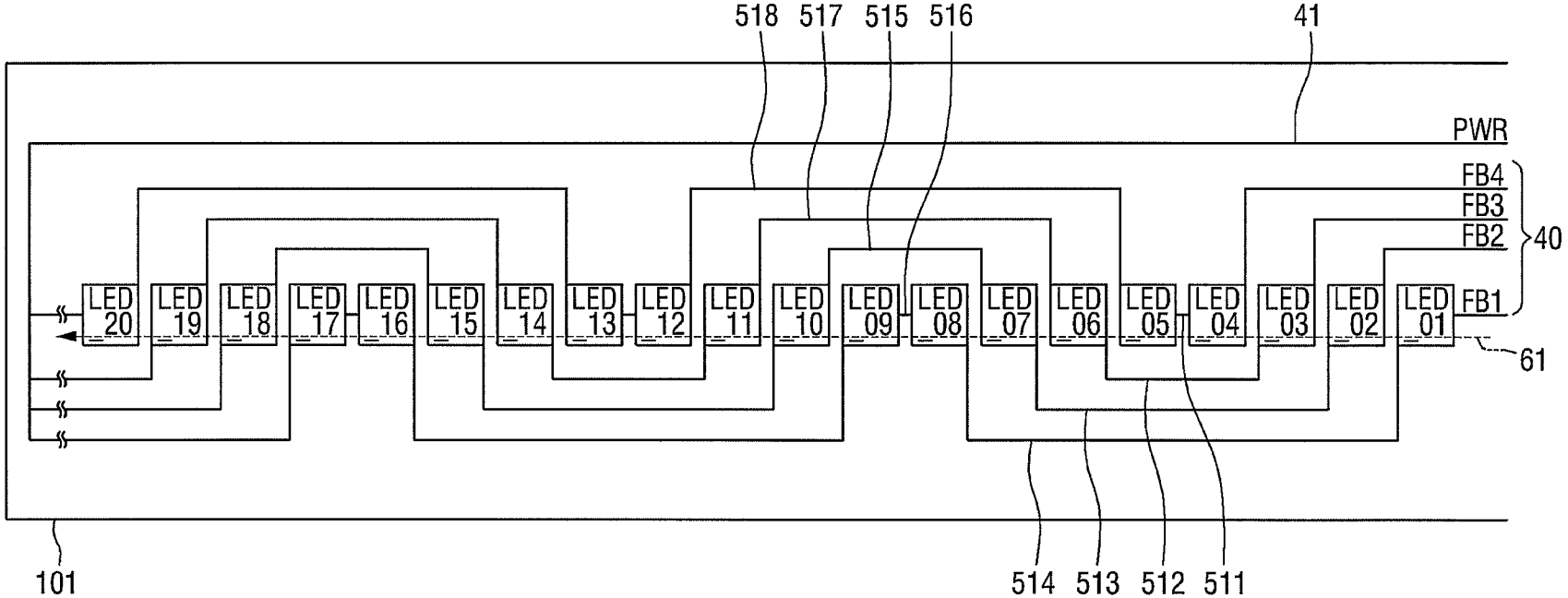
FIG. 2 is a diagram illustrating a circuit board that implements the circuit diagram of FIG. 1, according to an exemplary embodiment of the present invention.

FIG. 1 is a circuit diagram illustrating a plurality of light-emitting elements of a circuit board and the connections between the light-emitting elements according to an exemplary embodiment of the present invention. FIG. 2 is a diagram illustrating an exemplary embodiment of a circuit board that implements the circuit diagram of FIG. 1.

Referring to FIG. 1, the circuit board includes M light-emitting elements, wherein M is a natural number equal to or greater than 2. For example, in the exemplary embodiment of FIG. 1, M is equal to 32. The light-emitting elements may be, for example, light-emitting diodes (LEDs), and may be in the form of an integrated circuit.

Each M/Q light-emitting element of the M light-emitting elements are connected in series to form one of N branch lines 501-504, wherein N is a natural number equal to or greater than 2. Here, Q is a number of light-emitting elements arranged in parallel. In the exemplary embodiment of FIG. 1, Q is equal to 4, and thus M/Q is equal to 8. An end of each of the branch lines 501-504 is connected to a power line 41, and another end of each of the branch lines 501-504 is connected to one of a plurality of feedback lines 40 such as, for example, feedback lines 401-404. Each of the feedback lines 401-404 may be connected to one branch line as shown in the exemplary embodiment of FIG. 1, or each of the feedback lines 401-404 may be connected to two or more branch lines as shown in the exemplary embodiments of FIGS. 3 and 4. In addition, each of the feedback lines 401-404 may control an electrical signal which is transmitted to the power line 41. The electrical signal may be transmitted to a control unit (not shown) and may control the light-emitting elements.

The light-emitting elements may be implemented, for example, as light sources of a display apparatus (e.g., a liquid crystal display (LCD)), or may form part of a backlight unit that supplies light to the display apparatus.

Although FIG. 1 shows the light-emitting elements arranged in a matrix form, arrangement of the light-emitting elements is not limited thereto. For example, the light-emitting elements may be arranged substantially in a line as shown in FIG. 2, and in a line along a defined path 61, as indicated by the dotted line in FIG. 1.

Referring to FIGS. 1 and 2, a light-emitting element LED_01 of the first branch line 501, a light-emitting element LED_02 of the second branch line 502, a light-emitting element LED_03 of the third branch line 503, and a light-emitting element LED_04 of the fourth branch line 504 may be sequentially arranged along the defined path 61. A light-emitting element LED_05 of the fourth branch line 504, a light-emitting element LED_06 of the third branch line 503, a light-emitting element LED_07 of the second branch line 502, and a light-emitting element LED_08 of the first branch line 501 may be sequentially arranged along the defined path 61. The remaining light-emitting elements may be arranged in accordance with the defined path 61.

According to an exemplary embodiment of the present invention, the light-emitting elements may be arranged such that the circuit board has a single-layer structure.

In the exemplary embodiment shown in FIG. 2, N branch lines connect some of a plurality of light-emitting elements LED_01 through LED_20. N is a natural number greater than or equal to 2, and the N branch lines are formed in the same plane on a substrate 101. A first group of the N branch lines may be formed in the same plane as a second group of the N branch lines, but in a different region. For example, a first group of the N branch lines may be formed in a region above the plurality of light-emitting elements LED_01 through LED_20, and a second group of the N branch lines may be formed in a region below the plurality of light-emitting elements LED_01 through LED_20. As a result, the N branch lines may form a single layer.

In an exemplary embodiment of the present invention, the N branch lines may be disposed as shown in FIG. 2. For example, the light-emitting elements LED_01 through LED_20 may be arranged substantially in a line, and may be divided into a plurality of light-emitting groups. Each of the light-emitting groups may include a plurality of successively neighboring light-emitting elements. For example, the light-emitting groups may include first and second light-emitting groups. The first light-emitting group may include the light-emitting elements LED_01 through LED_08, and the second light-emitting group may include the light-emitting elements LED_09 through LED_16.

Light-emitting elements LED_01 and LED_08 included in the first light-emitting group are connected to each other by a branch line 514, which is located on a first side of the line in which the light-emitting elements LED_01 through LED_20 are arranged (e.g., "under" the line of light-emitting elements in FIG. 2). Light-emitting element LED_07 included in the first light-emitting group, and light-emitting element LED_10 included in the second light-emitting group, are connected to each other by a branch line 515 which is located on a second side of the line in which the light-emitting elements LED_01 through LED_20 are arranged (e.g., "above" the line of light-emitting elements in FIG. 2).

Forming the branch lines used to connect light-emitting elements included in the same light-emitting group and the branch lines used to connect light-emitting elements included in different light-emitting groups on different sides of the line in which the light-emitting elements are arranged may prevent intersection of the branch lines. As a result, a single-layer circuit board can be produced.

When a $K^{th}$ (K is a natural number) light-emitting element among a plurality of light-emitting elements LED_01 through LED_20 is connected in series to a $(K+2N+1)^{th}$ (N is a natural number) light-emitting element by a branch line, a $(K+L)^{th}$ (L is a natural number equal to or greater than 1 and equal to or less than N) light-emitting element may be connected in series to a $(K+2N+1-L)^{th}$ light-emitting element by another branch line.

For example, referring to FIG. 2, when K=1, N=3 and L=1 through 3, the first light-emitting element LED_01 and the eighth light-emitting element LED_08 may be connected in series by the branch line 514, the second light-emitting element LED_02 and the seventh light-emitting element LED_07 may be connected in series by a branch line 513, the third light-emitting element LED_03 and the sixth light-emitting element LED_06 may be connected in series by a branch line 512, and the fourth light-emitting element LED_04 and the fifth light-emitting element LED_05 may be connected in series by a branch line 511. The branch lines 512-514 are located on a first side of the line in which the light-emitting elements are arranged (e.g., "under" the line of light-emitting elements in FIG. 2).

When the $(K+2N+1)^{th}$ light emitting element is connected in series to a $(K+2N+2)^{th}$ light-emitting element by a branch line, the $(K+2N+1-L)^{th}$ light-emitting element may be connected in series to a $(K+2N+2+L)^{th}$ light-emitting element by another branch line.

For example, referring to FIG. 2, when K=1, N=3 and L=1 through 3, the eighth light-emitting element LED_08 and the ninth light-emitting element LED_09 may be connected in series by a branch line 516, the seventh light-emitting element LED_07 and the tenth light-emitting element LED_10 may be connected in series by the branch line 515, the sixth light-emitting element LED_06 and the eleventh light-emitting element LED_11 may be connected in series by a branch line 517, and the fifth light-emitting element LED_05 and the twelfth light-emitting element LED_12 may be connected in series by a branch line 518. The branch lines 515, 517 and 518 are located on a second side of the line in which the light-emitting elements are arranged (e.g., "above" the line of light-emitting elements in FIG. 2).

The substrate 101 may be, for example, a printed circuit board (PCB) or a flexible PCB (FPCB), however, the form and material of the substrate 101 are not limited thereto.

Figure 3:
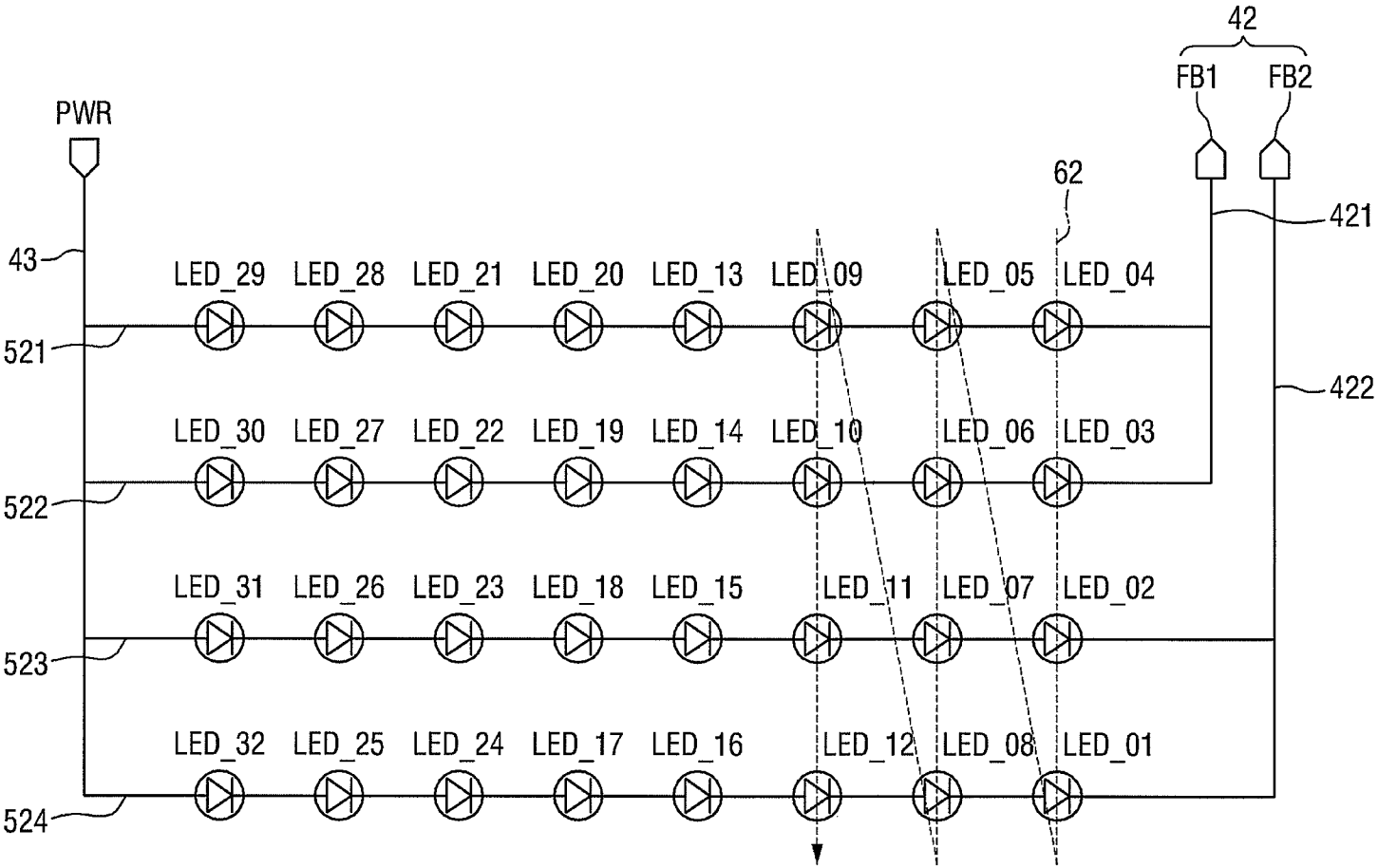
FIG. 3 is a circuit diagram illustrating a plurality of light-emitting elements of a circuit board and the connections between the light-emitting elements, according to an exemplary embodiment of the present invention.
Figure 4:
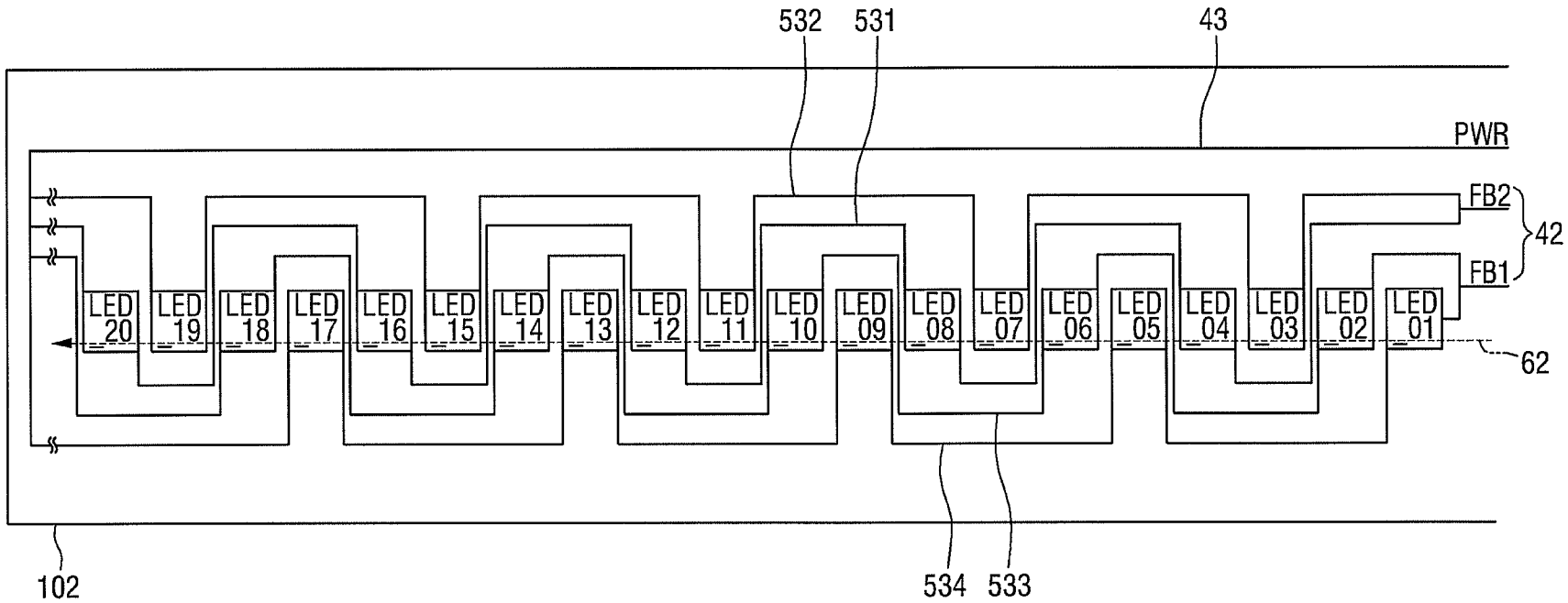
FIG. 4 is a diagram illustrating a circuit board that implements the circuit diagram of FIG. 3, according to an exemplary embodiment of the present invention.

FIG. 3 is a circuit diagram illustrating a plurality of light-emitting elements of a circuit board and the connections between the light-emitting elements according to an exemplary embodiment of the present invention. FIG. 4 is a diagram illustrating an exemplary embodiment of a circuit board that implements the circuit diagram of FIG. 3.

Referring to FIG. 3, the circuit board includes M light-emitting elements, wherein M is a natural number equal to or greater than 2. For example, in the exemplary embodiment of FIG. 3, M is equal to 32. The light-emitting elements may be, for example, LEDs and may be in the form of an integrated circuit.

Each M/Q light-emitting element of the M light-emitting elements are connected in series to form one of N branch lines 521-524, wherein N is a natural number equal to or greater than 2. In the exemplary embodiment of FIG. 3, Q is equal to 4, and thus M/Q is equal to 8. An end of each of the branch lines 521-524 is connected to a power line 43, and another end of each of the branch lines 521-524 is connected to one of a plurality of feedback lines 42 such as, for example, feedback lines 421 and 422. Each of the feedback lines 421 and 422 may be connected to two or more branch lines, as shown in FIGS. 3 and 4. In addition, each of the feedback lines 421 and 422 may control an electrical signal which is transmitted to the power line 43. The electrical signal may be transmitted to a control unit (not shown) and may control the light-emitting elements.

The light-emitting elements may be implemented, for example, as light sources of a display apparatus (e.g., an LCD), or may form part of a backlight unit that supplies light to the display apparatus.

Although FIG. 3 shows the light-emitting elements arranged in a matrix form, arrangement of the light-emitting elements is not limited thereto. For example, the light-emitting elements may be arranged substantially in a line as shown in FIG. 4, and in a line along a defined path 62, as indicated by the dotted line in FIG. 3.

Referring to FIGS. 3 and 4, a light-emitting element LED_01 of the first branch line 521, a light-emitting element LED_02 of the second branch line 522, a light-emitting element LED_03 of the third branch line 523, and a light-emitting element LED_04 of the fourth branch line 524 may be sequentially arranged along the defined path 62. A light-emitting element LED_05 of the first branch line 521, a light-emitting element LED_06 of the second branch line 522, a light-emitting element LED_07 of the third branch line 523, and a light-emitting element LED_08 of the fourth branch line 524 may be sequentially arranged along the defined path 62. The remaining light-emitting elements may be arranged in accordance with the defined path 62.

According to an exemplary embodiment of the present invention, the light-emitting elements may be arranged such that the circuit board has a single-layer structure.

In an exemplary embodiment of the present invention, the N branch lines may be disposed as shown in FIG. 4. For example, a $K^{th}$ light-emitting element among a plurality of light-emitting elements may be connected in series to a $(K+P)^{th}$ (P is a natural number equal to or greater than the number of branch lines in the plurality of branch lines) light-emitting element by a branch line, and a $(K+1)^{th}$ light-emitting element may be connected in series to a $(K+P+1)^{th}$ light-emitting element by another branch line. The branch line that connects the $K^{th}$ light-emitting element and the $(K+P)^{th}$ light-emitting element may be located on a first side of the line in which the light-emitting elements are arranged, and the branch line that connects the $(K+1)^{th}$ light-emitting element and the $(K+P+1)^{th}$ light-emitting element may extend from the $(K+1)^{th}$ light-emitting element towards the first side of the line of light-emitting elements, pass between the $(K+P)^{th}$ light-emitting element and the $(K+P+1)^{th}$ light-emitting element, and be connected to the $(K+P+1)^{th}$ light-emitting element on a second side of the line of light-emitting elements.

For example, referring to FIG. 4, when K=1 and P=4, the first light-emitting element LED_01 and the fifth light-emitting element LED_05 are connected in series by a branch line 534, and the second light-emitting element LED_02 and the sixth light-emitting element LED_06 are connected in series by a branch line 533. The fourth light-emitting element LED_04 and the eighth light-emitting element LED_08 are connected in series by a branch line 531, and the third light-emitting element LED_03 and the seventh light-emitting element LED_07 are connected in series by a branch lines 532. The branch line 534 is located on the first side of the line of light-emitting elements (e.g., "under" the line of light-emitting elements), and the branch line 533 extends from the second light-emitting element LED_02 towards the first side of the line of light-emitting elements (e.g., "under" the line of light-emitting elements), passes between the fifth light-emitting element LED_05 and the fourth light-emitting element LED_04, and is connected to the sixth light-emitting element LED_06 on the second side of the line of light-emitting elements (e.g., "above" the line of light-emitting elements). The branch line 532 is located on the second side of the line of light-emitting elements (e.g., "above" the line of light-emitting elements), and the branch line 531 extends from the fourth light-emitting element LED_04 towards the second side of the line of light-emitting elements (e.g., "above" the line of light-emitting elements), passes between the sixth light-emitting element LED_06 and the seventh light-emitting element LED_07, and is connected to the eight light-emitting element LED_08 on the first side of the line of light-emitting elements (e.g., "below" the line of light-emitting elements).

In a circuit board and a display apparatus according to an exemplary embodiment of the present invention, LEDs utilized as a light source can be mounted on a single-layer substrate rather than a multi-layer substrate, and the luminance uniformity of the LEDs may be maintained. Therefore, the unit cost of a substrate and a circuit board consisting of LEDs mounted on the substrate can be reduced.

Although exemplary embodiments of the present invention have been described hereinabove, it should be understood that the present disclosure is not limited to these embodiments, but may be modified by those skilled in the art without departing from the spirit and scope of the present invention, as defined by the appended claims.

What is claimed is:

1. A circuit board comprising:

a substrate;

a plurality of light-emitting elements arranged substantially in a line on the substrate; and a plurality of branch lines connecting the light-emitting elements to each other in series, wherein a first group of the plurality of branch lines is formed on a first side of the line of the plurality of light-emitting elements, and a second group of the plurality of branch lines is formed on a second, opposing side of the line of the plurality of light-emitting elements, wherein at least one branch line from among each of the first and second groups of the plurality of branch lines connects two non-adjacent light-emitting elements from among the plurality of light-emitting elements.

2. The circuit board of claim 1, wherein the light-emitting elements are light-emitting diodes.

3. The circuit board of claim 1, wherein the substrate is formed as a single layer substrate.

4. The circuit board of claim 1, wherein the plurality of light-emitting elements are divided into a first group and a second group, and each group comprises a plurality of successively neighboring light-emitting elements, wherein the first group and the second group are adjacent to each other, a first light-emitting element and a second light-emitting element in the first group are connected by a first branch line located on the first side of the line of the plurality of light-emitting elements, and the first light-emitting element in the first group and a third light-emitting element in the second group are connected by a second branch line located on the second side of the line of the plurality of light-emitting elements.

5. A circuit board comprising:

a substrate;

a plurality of light-emitting elements arranged substantially in a line on the substrate; and a plurality of branch lines connecting the light-emitting elements to each other in series, wherein a first group of the plurality of branch lines is formed on a first side of the line of the plurality of light-emitting elements, and a second group of the plurality of branch lines is formed on a second, opposing side of the line of the plurality of light-emitting elements, wherein a K-th light-emitting element in the plurality of light-emitting elements is connected in series to a (K+2N+1)-th light-emitting element by a first branch line, and a (K+L)-th light-emitting element is connected in series to a (K+2N+1−L)-th light-emitting element by a second branch line, wherein N is equal to a number of branch lines in the plurality of branch lines, and L is a number greater than or equal to 1 and less than or equal to N.

6. The circuit board of claim 5, wherein the first branch line and the second branch line are located on a same side of the line of the plurality of light-emitting elements.

7. The circuit board of claim 5, wherein the (K+2N+1)-th light-emitting element is connected in series to a (K+2N+2)-th light-emitting element by a third branch line, and the (K+2N+1−L)-th light-emitting element is connected in series to a (K+2N+2+L)-th light-emitting element by a fourth branch line.

8. The circuit board of claim 7, wherein the fourth branch line is located on the first side of the line of the plurality of light-emitting elements, and the first branch line and the second branch line are located on the second side of the line of the plurality of light-emitting elements.

9. The circuit board of claim 1, wherein a K-th light-emitting element in the plurality of light-emitting elements is connected in series to a (K+P)-th light-emitting element by a first branch line, and a (K+1)-th light-emitting element is connected in series to a (K+P+1)-th light-emitting element by a second branch line, wherein P is a number greater than or equal to a number of branch lines in the plurality of branch lines, the first branch line is located on the first side of the line of the plurality of light-emitting elements, and the second branch line extends from the (K+1)-th light-emitting element towards the first side of the line of the plurality of light-emitting elements, passes between the (K+P)-th light-emitting element and a (K+P−1)-th light-emitting element, and is connected to the (K+P+1)-th light-emitting element on the second side of the line of the plurality of light-emitting elements.

10. The circuit board of claim 1, wherein a power line for supplying power to the plurality of light-emitting elements is connected to an end of each of the plurality of branch lines.

11. The circuit board of claim 10, wherein a feedback line for detecting a current value of each of the plurality of branch lines is connected to another end of each of the plurality of branch lines.

12. A display apparatus comprising:

a display panel; and a backlight unit supplying light to the display panel, wherein the backlight unit comprises a plurality of light-emitting elements mounted on a substrate, and at least one of the light-emitting elements is connected to an internal wiring on the substrate, wherein the plurality of light-emitting elements are arranged substantially in a line on the substrate and are connected in series by a plurality of branch lines, wherein a first group of the plurality of branch lines is formed on a first side of the line of the plurality of light-emitting elements, and a second group of the plurality of branch lines is formed on a second, opposing side of the line of the plurality of light-emitting elements, wherein at least one branch line from among each of the first and second groups of the plurality of branch lines connects two non-adjacent light-emitting elements from among the plurality of light-emitting elements.

13. The display apparatus of claim 12, wherein the light-emitting elements are light-emitting diodes.

14. The display apparatus of claim 12, wherein the substrate is formed as a single layer substrate.

15. The display apparatus of claim 12, wherein the plurality of light-emitting elements are divided into a first group and a second group, and each group comprises a plurality of successively neighboring light-emitting elements, wherein the first group and the second group are adjacent to each other, a first light-emitting element and a second light-emitting element in the first group are connected by a first branch line located on the first side of the line of the plurality of light-emitting elements, and the first light-emitting element in the first group and a third light-emitting element in the second group are connected by a second branch line located on the second side of the line of the plurality of light-emitting elements.

16. The display apparatus of claim 12, wherein a K-th light-emitting element in the plurality of light-emitting elements is connected in series to a (K+2N+1)-th light-emitting element by a first branch line, and a (K+L)-th light-emitting element is connected in series to a (K+2N+1−L)-th light-emitting element by a second branch line, wherein N is equal to a number of branch lines in the plurality of branch lines, and L is a number greater than or equal to 1 and less than or equal to N.

17. The display apparatus of claim 16, wherein the first branch line and the second branch line are located on a same side of the line of the plurality of light-emitting elements.

18. The display apparatus of claim 16, wherein the (K+2N+1)-th light-emitting element is connected in series to a (K+2N+2)-th light-emitting element by a third branch line, and the (K+2N+1−L)-th light-emitting element is connected in series to a (K+2N+2+L)-th light-emitting element by a fourth branch line.

19. The display apparatus of claim 18, wherein the fourth branch line is located on the first side of the line of the plurality of light-emitting elements, and the first branch line and the second branch line are located on the second side of the line of the plurality of light-emitting elements.

20. The display apparatus of claim 12, wherein a K-th light-emitting element in the plurality of light-emitting elements is connected in series to a (K+P)-th light-emitting element by a first branch line, and a (K+1)-th light-emitting element is connected in series to a (K+P+1)-th light-emitting element by a second branch line, wherein P is a number greater than or equal to a number of branch lines in the plurality of branch lines, the first branch line is located on the first side of the line of the plurality of light-emitting elements, and the second branch line extends from the (K+1)-th light-emitting element towards the first side of the line of the plurality of light-emitting elements, passes between the (K+P)-th light-emitting element and a (K+P−1)-th light-emitting element, and is connected to the (K+P+1)-th light-emitting element on the second side of the line of the plurality of light-emitting elements.

* * * * *